US008827498B2

(12) United States Patent
Johnston et al.

(10) Patent No.: US 8,827,498 B2
(45) Date of Patent: Sep. 9, 2014

(54) LED LIGHT SOURCE HAVING GLASS HEAT PIPE WITH FIBERGLASS WICK

(75) Inventors: David W. Johnston, Kensington, NH (US); Gregory Zaslavsky, Marblehead, MA (US); Jeffery J. Serre, Peabody, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 1189 days.

(21) Appl. No.: 12/286,438

(22) Filed: Sep. 30, 2008

(65) Prior Publication Data

US 2010/0079988 A1 Apr. 1, 2010

(51) Int. Cl.

| | |
|---|---|
| ***F21V 29/00*** | (2006.01) |
| ***F21S 8/10*** | (2006.01) |
| ***F21S 8/02*** | (2006.01) |
| *F21Y 101/02* | (2006.01) |

(52) U.S. Cl.

CPC ..... *F21V 29/004* (2013.01); *F21S 48/328* (2013.01); *F21S 8/02* (2013.01); *F21V 29/2212* (2013.01); *F21V 29/006* (2013.01); *F21Y 2101/02* (2013.01)

USPC ..... 362/294; 362/373; 362/544; 362/545

(58) Field of Classification Search

USPC ..... 362/234, 382, 373, 294, 547, 545

See application file for complete search history.

(56) References Cited

U.S. PATENT DOCUMENTS

| | | | | |
|---|---|---|---|---|
| 2,350,348 | A * | 6/1944 | Gaugler | 62/119 |
| 3,229,759 | A * | 1/1966 | Grover | 165/104.26 |
| 3,229,959 | A | 1/1966 | Grover | 165/105 |
| 3,576,210 | A * | 4/1971 | Trent | 165/104.26 |
| 3,595,304 | A * | 7/1971 | McHugh | 165/104.16 |
| 3,627,899 | A * | 12/1971 | Moore | 174/15.3 |
| 3,712,053 | A * | 1/1973 | Kofink | 60/531 |
| 3,786,861 | A * | 1/1974 | Eggers | 165/104.26 |
| 4,018,269 | A * | 4/1977 | Honda et al. | 165/104.26 |

(Continued)

FOREIGN PATENT DOCUMENTS

| | | |
|---|---|---|
| EP | 1752720 | 2/2007 |
| JP | 2008-122024 | 5/2008 |
| KR | 2007-0116331 | 12/2007 |

OTHER PUBLICATIONS

Abstract KR 2007-0116331.

(Continued)

*Primary Examiner* — Ismael Negron
(74) *Attorney, Agent, or Firm* — Andrew Martin

(57) ABSTRACT

A light source (10) comprises a tubular glass heat pipe (12) having a given inside diameter ID. A tubular fiberglass wick (14) is positioned within the glass heat pipe (12). The fiberglass wick (14) has an outside diameter OD substantially equal to the given inside diameter ID and has a substantially centrally located open chamber (16) extending the length thereof. A quantity of an evaporable-condensable medium (17) is provided within the glass heat pipe (12) and a metal cap (18) selected from the group of glass-sealing metals and alloys is fixed to a proximal end (20) of the glass heat pipe (12). Heat dissipaters (22) are fixed to the distal end (24) of the heat pipe (12) and a light emitting diode (26) is fixed to the metal cap (18). Power conducting traces (28) are formed with the heat pipe (12) and are electrically connected to the light emitting diode (26). A lamp (40) can be formed with a plurality of the light sources (10).

2 Claims, 3 Drawing Sheets

(56) References Cited

U.S. PATENT DOCUMENTS

| | | | | | |
|---|---|---|---|---|---|
| 4,047,198 | A * | 9/1977 | Sekhon et al. | 257/713 |
| 4,067,315 | A * | 1/1978 | Fehlner et al. | 126/636 |
| 4,109,709 | A * | 8/1978 | Honda et al. | 165/104.26 |
| 4,125,387 | A * | 11/1978 | Gunter | 65/481 |
| 4,194,559 | A * | 3/1980 | Eastman | 165/104.26 |
| 4,511,952 | A * | 4/1985 | Vanbragt | 362/181 |
| 6,910,794 | B2 * | 6/2005 | Rice | 362/547 |
| 2006/0092639 | A1 | 5/2006 | Livesay | |

OTHER PUBLICATIONS

Abstract JP 2008-122024.

* cited by examiner

LED LIGHT SOURCE HAVING GLASS HEAT PIPE WITH FIBERGLASS WICK

TECHNICAL FIELD

This invention relates to light sources and more particularly to light sources employing light emitting diodes (LED or LEDs). Still more particularly, it relates to lamps using LEDs as the light source and to cooling structures for use with such light sources.

BACKGROUND ART

LEDs as light sources for illumination have greatly improved, enabling applications for so-called general light purposes, as opposed to the prior use as warning lights, for example. While LEDs now approach the performance level of traditional light sources, they require the heat-dissipaters to maintain their light output and expected life times. While this problem (heat removal) is not great when low-power LEDs (below 0.5 watts) are used, it becomes a serious problem in applications that call for high power density.

Typically, heat dissipation is dealt with by a variety of means, such, for example, as substantial heat sinks; forced convection, circulating cooling liquid; heat pipes; or various combinations of these devices.

For example, U.S. Pat. No. 6,910,794 discloses an automotive lighting assembly that includes a metal heat pipe using an evaporation area and condensing area located remote from the evaporation area. Such structures are relatively massive and difficult to fabricate.

Other, large scale heat pipes have also been proposed, for large scale cooling operations, for example, those shown in U.S. Pat. Nos. 2,350,348 and 3,229,759; however, these relatively massive devices are virtually incompatible with small scale LEDs and, moreover, do not provide for direct LED mounting.

DISCLOSURE OF INVENTION

Therefore, it is an object of the invention to obviate the disadvantages of the prior art.

It is another object of the invention to improve LED-heat pipes.

Yet another object of the invention is the enhancement of LED cooling.

These objects are accomplished, in one aspect of the invention, by the provision of a light source comprising: a tubular glass heat pipe having a given inside diameter; a tubular fiberglass wick positioned within the glass heat pipe, the fiberglass wick having an outside diameter substantially equal to the given inside diameter and having a substantially centrally located open chamber extending the length thereof; a quantity of an evaporable-condensable medium within the glass heat pipe; a metal cap selected from the group of glass-sealing metals and alloys fixed to a proximal end of the glass heat pipe; heat dissipaters fixed to the distal end of the heat pipe; a light emitting diode fixed to the metal cap; and power conducting traces formed with the heat pipe and electrically connected to the light emitting diode.

In another embodiment of the invention, a plurality of the light sources are combined to form a lamp, which, while useable in many applications, is efficiently used for down lighting.

The light sources are convenient, of small size and light weight, use readily available materials and are economical to manufacture.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
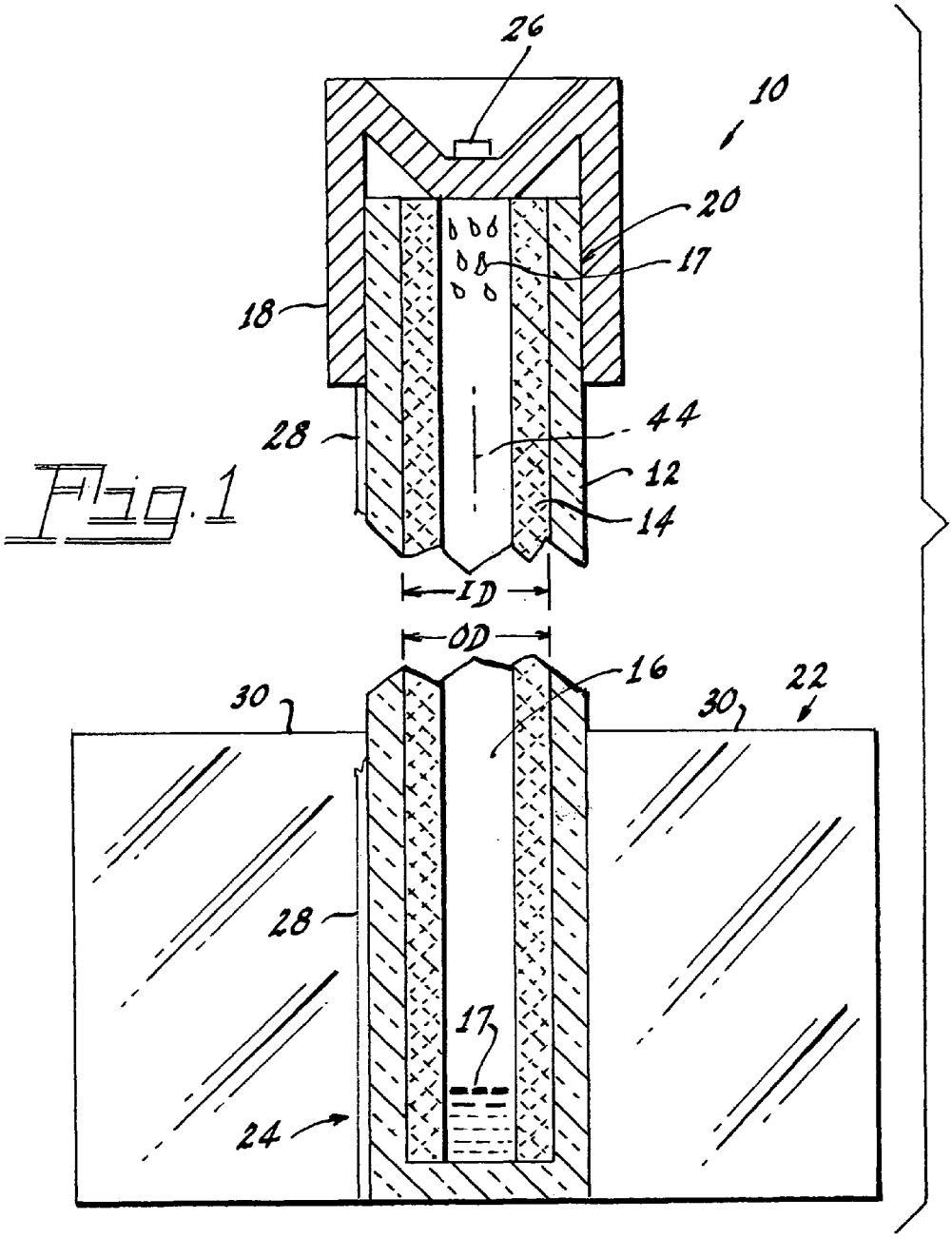
FIG. 1 is a broken, sectional elevation view of an embodiment of the invention.

Referring now to the drawings with greater particularity, there is shown in FIG. 1 a light source 10 comprising a tubular glass heat pipe 12 having a given inside diameter ID. In a preferred embodiment, the glass heat pipe comprises lead glass tubing having an ID of 4 mm with a wall thickness of 0.5 mm and, therefore, an outside diameter of 5 mm.

A metal cap 18 selected from the group of glass-sealing metals and alloys is fixed to a proximal end 20 of the glass heat pipe 12 by flame sealing.

A tubular fiberglass wick 14 is positioned within the glass heat pipe 12, the fiberglass wick 14 having an outside diameter OD substantially equal to the given inside diameter ID of the glass tubing and has a substantially centrally located open chamber 16 extending the length thereof. Before insertion the fiberglass wick is fired in air at 575° C. for 25 minutes to remove all binders. In a preferred embodiment, the fiberglass wick is a woven material.

A quantity of an evaporable-condensable medium 17, preferably, water, is dispensed within the glass heat pipe 12. preferably by a syringe, in an amount sufficient to saturate the wick. Excess fluid is removed by use of the syringe, also.

The bottom or distal end 24 of the glass heat pipe 12 is then submerged in liquid hydrogen and pumped to ~50 microns, tipped, and returned to room temperature. Heat dissipaters 22, preferably in the form of radiating fins 30, are fixed to the distal end 24 of the heat pipe 12.

To complete the assembly, a light emitting diode 26 is fixed to the metal cap 18; and power-conducting traces 28 (if not already present) are formed with the heat pipe 12 and electrically connected to the light emitting diode 26. The power-conducting traces can be formed externally on the or internally.

Figure 3:
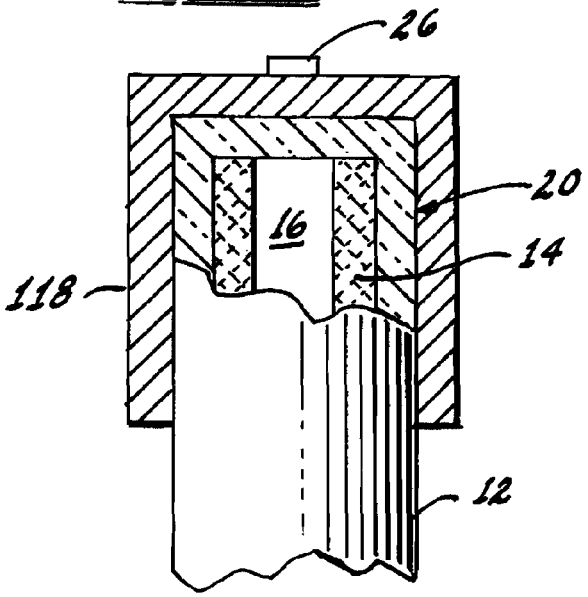
FIG. 3 is a partial, sectional elevation of another embodiment of a light source.

The metal cap can be formed with a flat or planar upper surface, as metal cap 118 shown in FIG. 3, or, preferably, can be formed with a concave upper surface, as metal cap 18 shown in FIG. 1.

Figure 2:
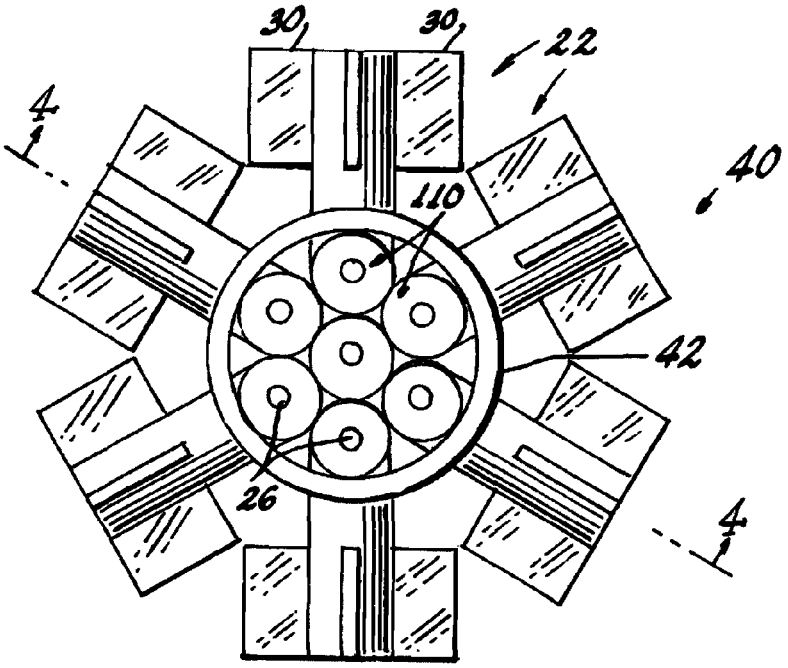
FIG. 2 is a plan view of a lamp according to an embodiment of the invention.
Figure 4:
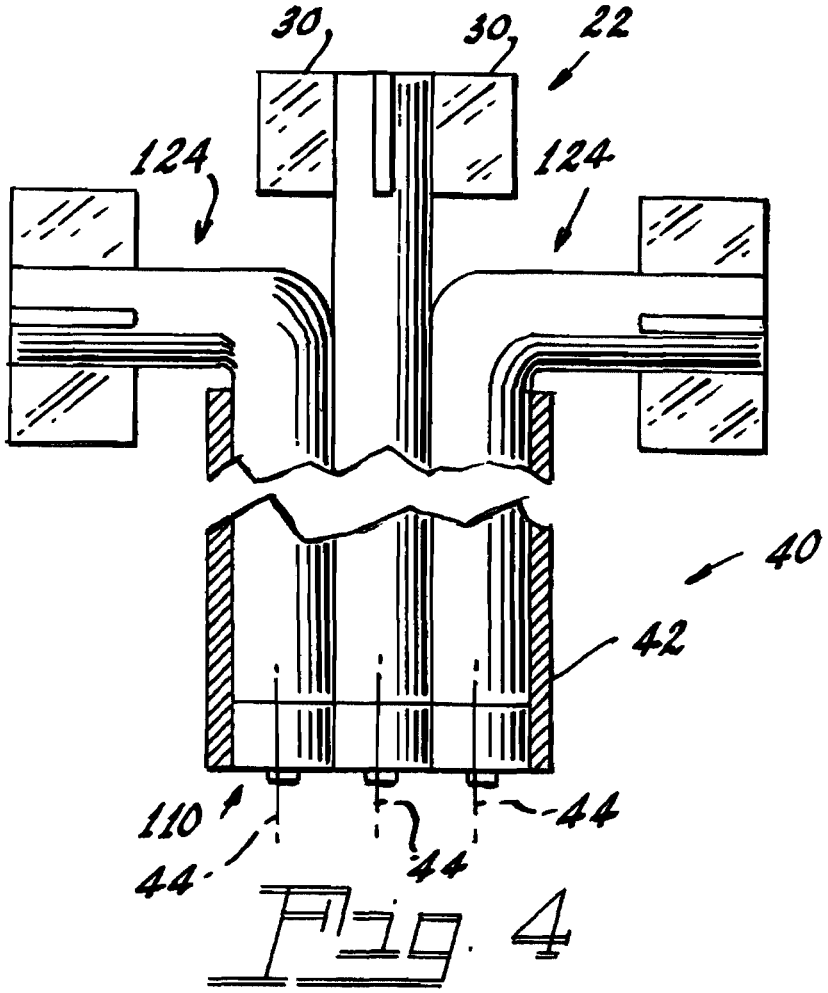
FIG. 4 is a sectional view taken along the line 4-4 of FIG. 2.

In another aspect of the invention, a lamp 40 (see FIGS. 2 and 4) can comprise a hollow body 42 fitted with a plurality of the light sources 110. If necessary for volume accommodation purposes, the proximal ends 20 of the glass heat pipes 12 can extend along a longitudinal axis 44 and some of said distal ends 124 of the glass heat pipes 12 can be formed at an angle of up to 90° from the longitudinal axis 44.

Thus there is provided a simple and inexpensive light source supplied with a competent heat pipe for temperature control during operation.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A lamp comprising:

a hollow body; and a plurality of light sources fitted into said hollow body, each of said light sources comprising:

a tubular glass heat pipe having a given inside diameter;

a tubular fiberglass wick positioned within said glass heat pipe, said fiberglass wick having an outside diameter substantially equal to said given inside diameter and having a substantially centrally located open chamber extending the length thereof;

a quantity of an evaporable-condensable medium within said glass heat pipe;

a metal cap selected from the group of glass-sealing metals and alloys fixed to a proximal end of said glass heat pipe;

heat dissipaters fixed to the distal end of said glass heat pipe;

a light emitting diode fixed to said metal cap; and power conducting traces formed with said heat pipe and electrically connected to said light emitting diode.

2. The lamp of claim 1 wherein said proximal ends of some of said glass heat pipes extend along a longitudinal axis and said distal ends of said glass heat pipe are formed at an angle of up to 90° from said longitudinal axis.

* * * * *